US006435150B1

(12) United States Patent
Loughlin et al.

(10) Patent No.: US 6,435,150 B1
(45) Date of Patent: Aug. 20, 2002

(54) OFFSET TAPPET ASSEMBLY

(75) Inventors: Neil W Loughlin, Ortonville; David James, Rochester Hills, both of MI (US)

(73) Assignee: DaimlerChrysler Corporation, Auburn Hills, MI (US)

( * ) Notice: Subject to any disclaimer, the term of this patent is extended or adjusted under 35 U.S.C. 154(b) by 0 days.

(21) Appl. No.: 09/625,553

(22) Filed: Jul. 25, 2000

(51) Int. Cl.[7] ..... F01L 1/14
(52) U.S. Cl. ..... 123/90.48; 74/569
(58) Field of Search ..... 123/90.33, 90.35, 123/90.48, 90.49, 90.5; 74/569; 29/888.43, 888.03

(56) References Cited

U.S. PATENT DOCUMENTS 5,263,386 A * 11/1993 Campbell ..... 74/569
5,402,756 A * 4/1995 Bohme ..... 123/90.16
5,415,138 A * 5/1995 Hudson ..... 123/90.43
5,857,438 A * 1/1999 Barnard ..... 123/90.16
5,860,398 A 1/1999 Koerner
5,947,069 A 9/1999 Koerner

* cited by examiner

*Primary Examiner*—Thomas Denion
*Assistant Examiner*—Jaime Corrigan
(74) *Attorney, Agent, or Firm*—Ralph E. Smith

(57) ABSTRACT

A tappet is provided including a foot having a cam contact surface and an axial bore formed therein; a tappet body having a body portion with an axially extending hub for reception in the axial bore of the foot; and a bearing assembly positioned between the foot and the tappet body, the bearing assembly operating to reduce friction as the foot separately rotates axially about a centerline of the tappet body.

5 Claims, 2 Drawing Sheets

OFFSET TAPPET ASSEMBLY

FIELD OF THE INVENTION

This invention relates to engine tappets or lifters, and more specifically, to a form of mechanical tappets including roller ends and methods of manufacture thereof.

BACKGROUND OF THE INVENTION

In an internal combustion engine, the tappet is a well-known device and is also commonly referred to as a lifter or valve lifter. For examples of common forms of tappets, see "Automotive Mechanics" ($10^{th}$ Ed.) by William H. Crouse and Donald L. Anglin, McGraw-Hill (1993), ISBN 0-02-800943-6 at pp. 131, and 169–170; "Power Secrets" by Smokey Yunick and Larry Schrieb, S-A Design Books (1989), ISBN 0-931472-06-7 at pp. 76–80; Regueivo U.S. Pat. Nos. 5,445,119; 5,638,783; and 5,682,849; and Koerner U.S. Pat. Nos. 5,860,398 and 5,947,069. The disclosures of U.S. Pat. Nos. 5,860,398 and 5,947,069 are incorporated by reference herein.

FIG. 1 depicts a typical tappet application for a push rod engine. In general, a lifter or tappet interacts directly with a rotating camshaft in the engine's valve train. That interaction begins the chain of events that converts the rotary motion of the camshaft into the reciprocating motion of the engine's intake and exhaust valves. The amount of horsepower generated by an engine is related to how efficiently the valve train operates. Indeed, it is common knowledge that of all the adjustments that can be made to an internal combustion engine, adjustments to the valve train have the greatest impact on increasing horsepower.

In general, the more efficiently air enters and combusted gas exits an engine, as controlled by the opening and closing of the intake and exhaust valves, the more horsepower the engine will produce. "Lifting," or opening the valves as high and as fast as possible, and closing the valves as fast as possible, are necessary to obtain efficient air and gas flow, and to achieve optimum horsepower. "High lift" is generally obtained by designing a camshaft having aggressive cam lobes with steep flank angles. Consequently, in high-performance applications, a tappet must be able to reliably negotiate the contour of an aggressive cam lobe at extremely high rpm's. In addition, the tappet must be durable and capable of withstanding extreme frictional forces and high valve spring pressures.

Push rod-type internal combustion engines typically use one of four types of tappets or lifters: the flat mechanical tappet, the mushroom tappet, the roller tappet, or the hydraulic tappet. Each of these types of tappets or lifters is discussed briefly below.

The single piece, flat mechanical tappet is inexpensive, simple to produce, and reliable in stock environments, and has been the industry standard for years. In high performance applications, however, the flat mechanical tappet has several limitations. First, the flat mechanical tappet requires an extensive and detailed break-in procedure. The break-in procedure typically includes: (1) polishing the lifter foot without disturbing the contour of its convex foot; (2) coating the camshaft lobes with a high performance lubricant; (3) preheating the engine oil before starting the engine, (4) installing light weight valve springs; (5) starting and running the engine for about thirty minutes at about 2500 rpm's to ensure that adequate oil circulation is present in the valve train, and that the tappets are broken in slowly; (6) after shutting down the engine, installing the proper valve springs. This tedious process is necessary to obtain optimum performance from both the tappets and camshaft. Second, mechanical tappets do not work well in high performance applications using aggressive camshafts characterized by lobes having steep opening and closing flanks.

The "mushroom tappet" was developed in an effort to address some of the limitations of the standard mechanical tappet, particularly for use with aggressive cam shaft designs. The mushroom tappet uses a foot with a larger diameter than the body of the tappet, which allows it to more easily negotiate the steeper flank angles of aggressively designed cam lobes. However, several drawbacks are also associated with mushroom tappets. First, before a mushroom tappet can be used, the engine block must usually be machined to ensure adequate clearance with the enlarged tappet foot. Second, the enlarged mushroom tappet foot requires that the tappet be inserted and removed from the bottom of the engine block, thereby complicating repairs or maintenance on the valve train. Third, even the mushroom tappet is characterized by relatively high friction rates requiring significant lubrication.

Moreover, all mechanical tappets are designed to rotate in their bore. The rotation is induced when the convex surface of the lifter foot is in contact the tapered, rotating, cam lobe. The rotation of the lifter or tappet in its bore is necessary to avoid prematurely wearing the lifter foot and cam lobe. However, several additional disadvantages are associated with tappet rotation. First, as the lifter rotates, considerable friction is generated between the surface area of the inside diameter of the lifter bore and the surface area of the outside diameter of the lifter body. Thus, mechanical tappets have relatively high friction rates that often require extensive modifications to the engine to increase the oil flow to the cam lobes and upper valve train in high-performance applications. Secondly, because mechanical tappets rotate, the use of "Rev Kits" (discussed below) has not been successful. Third, because the entire mechanical lifter rotates, it is not possible to use an offset push rod cup, which is often needed to gain additional push rod/cylinder head clearance in some applications. More specifically, offset pushrod cups are typically used in applications where the intake ports of the engine block have been bored to a larger size thus sometimes creating a less than zero clearance between the push-rod and engine block.

To reduce the adverse effects of friction between the tappet foot and cam lobe, it is highly desirable to make mechanical tappets that are both light and strong, thereby reducing friction. However, the tappet must still be strong enough to withstand the extreme pressures exerted from the valve springs and cam lobe, and durable enough to withstand the rotational forces between the cam lobe and cam foot. As a result, many types of lightweight, exotic, and expensive materials have been used to fabricate tappets. The optimum solution is one that would be able to utilize two different metals in the lifter. This would make it possible to use one type of metal for the lifter body, and one type for the lifter foot. However, the typical one-piece design of a mechanical tappet dictates using the same material for the entire lifter body.

The "roller tappet" was developed in large part to overcome the many disadvantages of the mechanical tappet. Roller tappets reduce friction between the cam lobe and lifter foot, thereby reducing lubrication requirements. Thus, roller tappets are desirable in high performance applications, as they can maintain valve train stability at high rpm's and aggressive camshaft designs. However, they likewise have several drawbacks.

First, many racing circuits do not allow the use of roller tappets. For example, one of the world's largest racing circuits, the Winston Cup Series, prohibits the use of roller tappets. Second, to achieve optimum performance with roller tappets, it is necessary to install an anti rotational device and Rev Kit, thereby further increasing the number of valve-train components, as well as the likelihood of failure. If failure occurs in a roller tappet, typically the results are instantly fatal to the engine.

A fourth common form of lifter is a hydraulic lifter. Hydraulic lifters have several advantages over both mechanical lifters and roller lifters. Hydraulic lifters automatically compensate for any clearance changes caused by temperature variation or wear. Thus, they should never need adjustment. Also because there is no clearance between the lifter foot and the cam lobe, hydraulic lifters are extremely quiet while in operation when compared to both mechanical or solid lifters. Mechanical or roller lifters need to have some clearance or "lash" between the lifter foot and the cam lobe to act as a cushion to allow for any tolerance changes due to thermal expansion or contraction encountered during repeated engine cycles.

However, hydraulic lifters also have some undesirable qualities. Hydraulic lifters are only as reliable as the cleanliness of the engine oil. Thus, if any dirt is present in the oil, the lifter will not compress or decompress properly, and valve and camshaft damage would soon result. Hydraulic lifters also do not work well at high rpm's, because the lifters have a tendency to "pump up" as the rpm's increase. In other words, as engine rpm's increase, more oil is introduced into the oil chamber, preventing the lifter from compressing and decompressing, and adversely impacting the stability of the valve train. The result, is a loss of compression and horse power because the valves are held off their seats.

Thus, the need exists for a new form of lifter or tappet that combines the many advantages of the different types of lifters or tappets with little or none of their varied disadvantages. Thus, a need exists for a multiple piece, roller-type mechanical tappet for use in high performance applications and that is effective, reliable, and inexpensive to produce.

To meet the aforedescribed needs, a tappet was put forth by Koerner in U.S. Pat. Nos. 5,860,398 and 5,947,069. Koerner discloses a tappet including a foot having a convex cam contact surface and an axially extending hub, a tappet body having a lower body portion with a lower axial bore formed therein to receive the axially extended hub of the foot, and a bearing assembly positioned between the foot and the lower portion of the tappet body. The Koerner cam contact surface operated in a frictional relationship with a cam lobe of a rotating cam. The frictional relationship between the cam lobe and the cam contact surface of the foot induces the foot to rotate about the centerline of the tappet. The Koerner bearing assembly operates to reduce friction as the foot independently rotates axially about a centerline of the tappet body.

The Koerner foot is removable from the lower bore in the tappet body. The Koerner bearing assembly comprises a lower race, an upper race, and a needle bearing placed between the lower race and the upper race. The foot includes a top flat surface formed to support the lower bearing race, and the lower portion of the tappet body includes a lower flat surface formed to contact the upper bearing race. The Koerner foot can be formed with a profile that matches a corresponding profile of the cam with which it cooperates.

The Koerner tappet includes a replaceable push rod receiver cup assembly supported by a top portion of the tappet body. The top portion of the Koerner tappet body includes an upper axial bore and a support shelf formed within the bore, and the replaceable push rod receiver cup assembly is supported on the support shelf within the bore in the top portion of the tappet body. The Koerner push rod receiver cup comprises a spacer and a mated receiver cup.

The Koerner tappet has certain disadvantages. One major disadvantage is that when the foot is towards the bottom of the tappet body the foot and the bearing assemblies are exposed outside of the casing. Another major disadvantage of the Koerner tappet assembly is that it requires the utilization of a retention screw between the hub and tappet body during the assembly to keep the foot from falling away from the tappet body. The removal of the retention screw can be bothersome and an inadvertent misplacement of the tappet screw within the engine could result in major damage to the engine. Additionally the tappet of Koerner is relatively complex in the amount of suffered parts which must be provided. It is desirable to provide a tappet which does not include these disadvantageous aspects of the Koerner tappet.

SUMMARY OF THE INVENTION

To make manifest the above noted and other desires the revelation of the present invention is brought forth. In its preferred embodiment the present invention brings forth a method of assembling a tappet which is set free from the requirement of a retention screw. In a preferred embodiment the present invention provides a tappet which has a foot with a cam contact surface. The foot has along an upper end an axially extending multi-diametered bore. The tappet of the present invention also provides a tappet body. The tappet body has extending therefrom an axial hub. The axial hub is also multi-diametered. A bearing assembly is positioned between the tappet body and the foot to reduce friction as the foot rotates axially about a centerline of the tappet body. In assembly the foot is either thermally expanded or the tappet body axial hub is exothermally contracted. The tappet body hub is then axially inserted within the axial bore of the foot. The hub or axial bore is allowed to return to room temperature creating a mechanical interlock which holds the tappet body and foot together. The foot can now have a height which allows the top end of the foot and the bearing assembly to always be positioned within the casing which is fitted within the engine block.

It is a feature of the present invention to provide a tappet having a foot with a cam surface and an axial bore formed therein. Additionally, the tappet has a tappet body having a body portion with an axially extending hub for reception into the axial bore of the foot. A bearing assembly is provided positioned between the foot and the tappet body operating to reduce friction as the foot separately rotates axially about a centerline of the tappet body.

It is another feature of the present invention to provide a tappet having a first member providing a foot with a cam contact surface and a second member providing a tappet body and an axially extending hub connected with one of the first and second members for interlocking extension into an axially extending bore of the other of the first or second members. A bearing assembly operation is positioned between the first and second members to reduce friction as the first and second members are separately rotated axially about a centerline of the second member.

It is another feature of the present invention to provide a method of assembling a tappet having a first member providing a foot with a cam contact surface and a second member providing a tappet body and a bearing assembly positioned between the foot and the tappet body to reduce friction as the foot separately rotates axially about a center line of the tappet body. The method includes extending from the first or second members an axial hub having a multi-diameter cylindrical surface with an enlarged portion within a multi-diameter axial bore of the other member by temporarily expanding the bore or contracting the axial hub to allow the hub to extend fully within the axial bore and then returning the axial bore or the axial hub to a prior dimension to form an interlocking relationship while still allowing the axial hub to rotate within the axial bore.

The above noted features of the present invention will become more apparent to those skilled in the art from a review of the invention as it is provided in the accompanying drawings and detailed description.

DETAILED DESCRIPTION OF THE INVENTION

The purpose and operation of a tappet or lifter is well known in the art. A tappet is a device designed to work in direct relation with a rotating camshaft for the purpose of opening and closing intake and exhaust valves in an internal combustion engine. There are basically four types of tappets—mechanical, mushroom, hydraulic, and roller. The present invention pertains primarily to a form of mechanical tappet.

Figure 1:
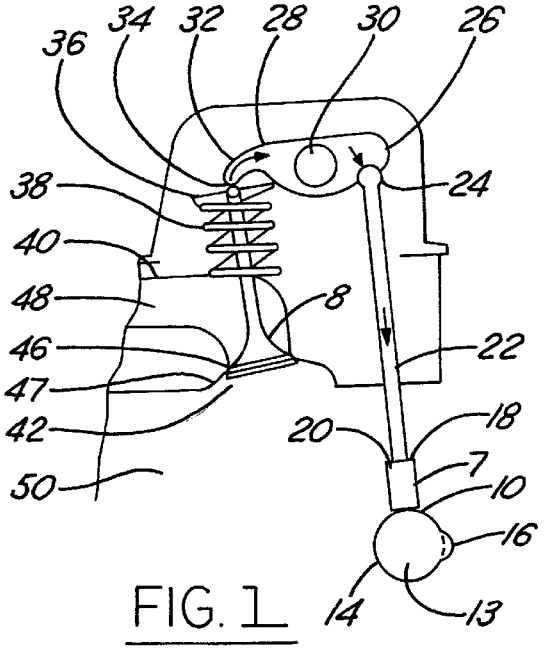
FIG. 1 is an operational view of a tappet according to the present invention utilized in the environment of an internal combustion engine wherein a valve assembly associated with said tappet is in a closed position.

FIG. 1 represents a conventional tappet and cam arrangement with valve 8 in the closed position, indicating that the engine cylinder is either in the ignition or compression cycle. A foot 10 of tappet 7 is in direct contact with a foot 14 (sometimes referred to as heel) of a cam 13. The opposite end of the tappet 7 forms a push rod receiver cup 18 that receives a spherical end 20 of a push rod 22. The opposing spherical end 24 of the push rod 22 is pivotally received into a receiver cup 26 of a rocker arm 28. The rocker arm 28 is mounted on a rocker arm shaft 30. The valve end 32 of the rocker arm 28 is in direct contact with a valve stem end 34. Located beneath the valve stem end 34 is a spring retainer 36 and a valve spring 38. The valve spring 38 is a compression spring and exerts constant pressure on cylinder head surface 40 and a spring retainer 36 when the valve is closed. A valve face 42 comprises a machined chamfered radial edge that forms a positive seal 46 with a valve seat 47 of an intake/exhaust port 48. The valve head is a flat surface on the bottom of the valve and forms the top of a compression chamber 50. The valve 8 remains in the closed position as long as foot 10 of tappet 7 is in contact with the cam foot portion 14 of cam 13, causing the valve spring 38 to exert force on the spring retainer 36, causing the entire valve train assembly to shift in the direction of the arrows, thus holding the valve 8 in the closed position.

Figure 2:
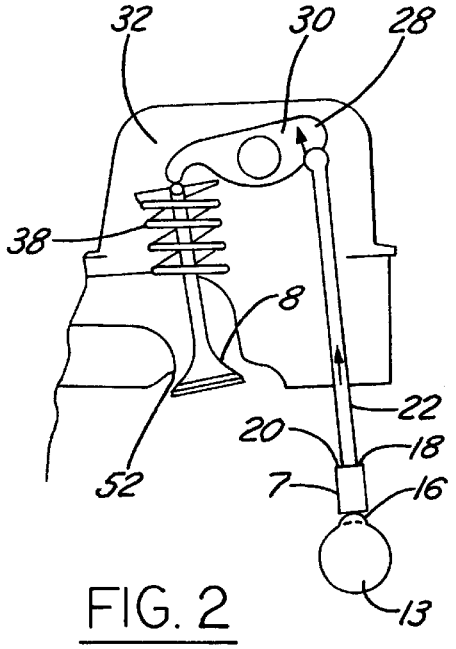
FIG. 2 is a view similar to that of FIG. 1 according to the present invention wherein a valve assembly associated with said tappet is in an opened position.

FIG. 2 depicts valve 8 in an open position, which occurs during the intake or exhaust cycle of the cylinder. Cam 13 rotates until the raised cam lobe 16 is positioned under cam foot 10 of tappet 7. The lobe 16 lifts the tappet 7 upward, forcing the push rod 22 to cause the rocker arm 28 to pivot on the rocker arm shaft 30. The valve end 32 of rocker arm 28 presses against valve stem top 34, causing valve spring 38 to compress and the valve 8 to open, as illustrated by the direction of the arrows.

FIGS. 1 and 2 collectively illustrate the basic operation of the valve train of a push rod internal combustion engine, including the manner in which the valves open and close. The opening and closing process perpetuates itself as long as fuel, ignition, and air are supplied to the combustion chamber. This process is fundamental to the operation of an internal combustion engine.

Figure 4:
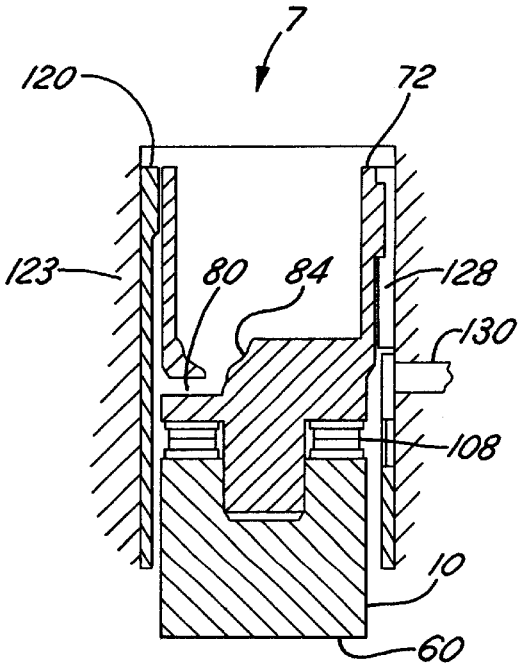
FIG. 4 is a sectional view of the tappet shown in FIG. 3 installed within a bushing within a wall of an internal combustion engine.
Figure 5:
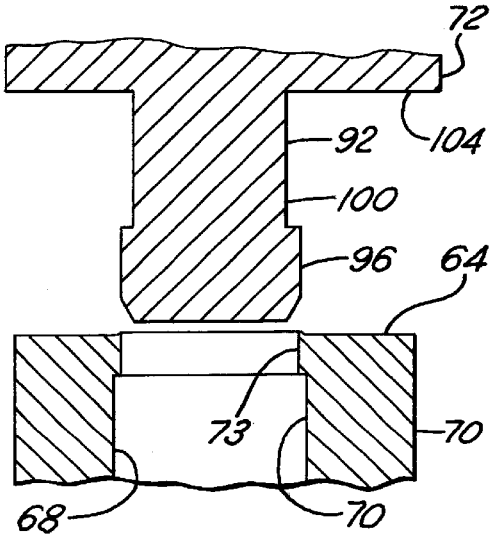
FIG. 5 is an enlargement of the interface between a tappet body and a tappet foot prior to the assembly of the tappet body with the tappet foot.
Figure 3:
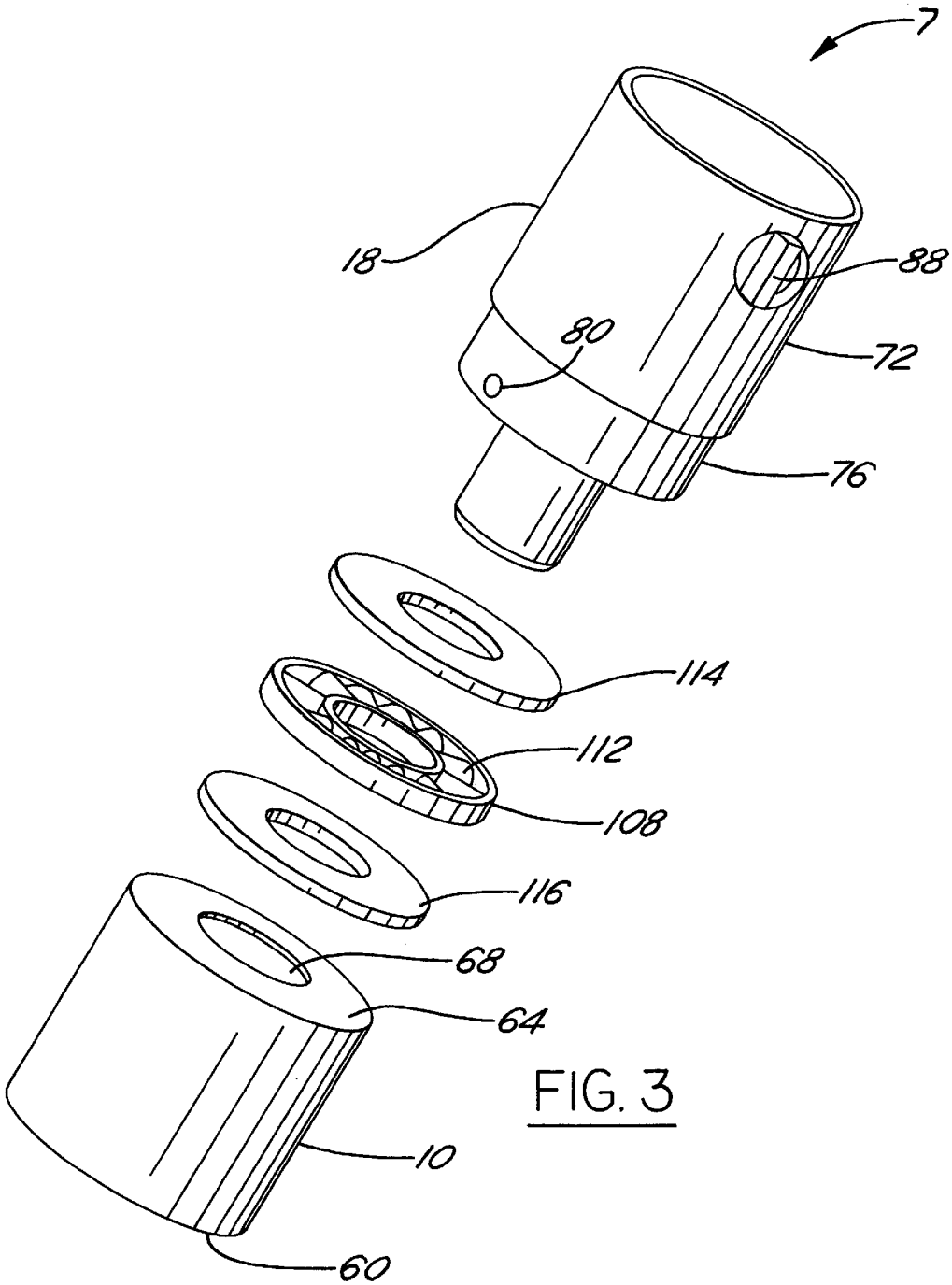
FIG. 3 is an enlarged exploded view of a tappet of the present invention shown in FIGS. 1 and 2.

Referring additionally to FIGS. 3–5, the tappet 7 has a first member provided by the foot 10. The foot 10 as shown has a generally flat cam contact surface 60. However, the cam contact surface 60 can be conical or some other form of rotated curvilinear surface as desired. A top end 64 of the foot is generally flat. Penetrating the top end 64 of the foot is a multi-diametered generally axial bore 68. The bore 68 has a large diameter portion 70 and a reduced diameter portion 73. A typical material utilized for the foot 10 will be 1060 steel or other suitable alternatives.

The second major component of the tappet 7 is a tappet body 72. The tappet body 72 along its upper end forms a receiver cup 18. A mid portion 76 of tappet body 72 is formed by an angular groove. The mid body 76 of the tappet body 72 has a radially intersecting bore forming a passageway 80 which connects with a well 84 which receives the spherical end 20 of the rocker arm 22. The passageway 80 is provided to allow lubricating oil to flow towards the well 84. The tappet body 72 also has a plastic deformed tab protrusion 88 to provide an anti-rotation feature. The lower end of the tappet body has an axially extending integrally connected hub 92. Hub 92 has a multi-diameter cylindrical surface having an enlarged portion 96 and a reduced diameter portion 100. The tappet body also has a bottom angular flat surface 104 which faces the foot 10. Positioned between the upper surface 64 of the foot and the lower surface 104 of the tappet body is a thrust bearing assembly 108. The thrust bearing assembly has a plurality of needle rollers 112. A thrust washer 114 covers the top of the bearing 108. A second thrust washer 116 covers a lower portion of the bearing 108.

In operation, a centerline of the cam 13 that the tappet foot 10 is contacting will be off-center from a centerline of the tappet body 72. Accordingly, the tappet foot 10 will be urged to rotate separately about the tappet body 72.

The enlarged diameter portion 96 of the hub 92 has a slight interference with the reduced diameter portion 73 of the axial bore 68 of the foot. At room temperatures or at temperatures normally expected during operation of the engine there is approximately five ten thousands of an inch interference. The enlarged portion 96 of the hub also has approximately a fifteen ten thousands of an inch clearance with the enlarged diameter portion 70 of the axial bore 68. The reduced diameter portion 100 of the hub has a similar clearance with the reduced diameter portion 73 of the axial bore of the foot. To assemble the tappet body 72 to the tappet foot 10, the tappet foot 10 is thermally expanded to provide sufficient clearance for the enlarged portion 96 of the hub 92 to enter into the axial bore 68 past the reduced diameter portion 73. The tappet foot 10 is then allowed to contract and the tappet body 72 and foot 10 are interlocked while still allowing the tappet foot 10 to freely rotate along the axis of the hub 92.

In an alternative to the above-described assembly procedure the hub 92 is exothermally contracted typically by an exposure to a cryogenic liquid and inserted as previously described. When utilizing an exothermic assembly operation it is important that the materials for the tappet body be properly selected so that it will not be too brittle during the assembly process. As will be apparent to those skilled in the art simultaneously with the assembly of the tappet body 72 with the foot 10 will be the penetration of the hub 92 through the washers 114 and 116 and the bearing assembly 108.

The tappet 7 is inserted within a bushing 120. The bushing 120 is press fit within a bore of the tappet boss 123 of the engine block. The bushing has a longitudinal slot 128 which captures the antirotational protrusion 88 of the tappet body.

One of the major advantages of the tappet 7 of the present invention is that the bearing 108 and the upper surface 64 of the tappet foot always remain within the bushing 120 during all positions of operation. The tappet boss 123 has an oil supply 130 (shown approximately 90" out of position in FIG. 4) which fluidly communicates with the well 84 and the mid body 76 of the tappet body. The tappet foot upper surface 64 always remains in the bushing 120 so that bearing assembly 108 is always in an oil filled cavity. The above-noted feature keeps the highly loaded bearing assembly lubricated and allows for a level of hydrodynamic lubrication to occur at the needles 112. This cushions the bearing assembly 108 from impact loading and lowers the running temperature of the bearing assembly 108. Also the bearing assembly 108 is directly exposed to the oil supply 130.

The present inventive tappet has been shown is a preferred embodiment. However, it is apparent to those skilled in the art that various modifications can be made to the present invention without departing from the spirit or scope of the present invention as it is encompassed in the specifications and drawings and by the following claims.

We claim:

1. A tappet comprising:

a first member providing a foot having a cam contact surface;

a second member providing a tappet body;

a hub axially extending from an end surface of one of said first and second members for insertion and locking into a bore axially formed in an end surface of said other first or second members to couple the first and second members together; and a bearing assembly positioned between said end surfaces of the first member and said second member, said bearing assembly operating to reduce friction as said first member separately rotates axially about a center line of said second member, wherein said tappet body is surrounded by a bushing and wherein said bearing assembly is always positioned within said bushing.

2. A tappet as described in claim 1, wherein said foot has said axial bore and said tappet body has said axially extending hub.

3. A tappet assembly as described in claim 1, wherein said tappet body is positioned within a bushing and said tappet body has a protrusion to prevent rotation of said tappet body within said bushing.

4. A tappet comprising:

a foot having a cam contact surface at a bottom end and an axial bore formed in a top end surface;

a tappet body having a hub axially extending from a bottom end surface for reception in said axial bore of said foot; and a bearing assembly positioned between the top end surface of said foot and the bottom end surface of said tappet body, said bearing assembly operating to reduce friction as said foot separately rotates axially about a center line of said tappet body, wherein the tappet body is surrounded by a bushing and wherein the bearing assembly is always positioned within said bushing.

5. A tappet assembly as described in claim 1, wherein said tappet body is positioned in a bushing and said tappet body has a protrusion to prevent rotation of said tappet body within said bushing.

* * * * *